US008776273B2

(12) United States Patent
Krause

(10) Patent No.: US 8,776,273 B2
(45) Date of Patent: Jul. 15, 2014

(54) SAFETY HAT SYSTEM

(71) Applicant: Joseph Krause, Matawan, NJ (US)

(72) Inventor: Joseph Krause, Matawan, NJ (US)

( * ) Notice: Subject to any disclaimer, the term of this patent is extended or adjusted under 35 U.S.C. 154(b) by 0 days.

(21) Appl. No.: 13/897,758

(22) Filed: May 20, 2013

(65) Prior Publication Data

US 2013/0247283 A1 Sep. 26, 2013

Related U.S. Application Data

(63) Continuation-in-part of application No. 13/155,537, filed on Jun. 8, 2011, now abandoned.

(51) Int. Cl.
*A42B 3/00* (2006.01)
*A42B 1/00* (2006.01)

(52) U.S. Cl.
USPC ..... 2/411; 2/175.3

(58) Field of Classification Search
USPC ..... 2/209.11, 209.13, 175.3, 175.6, 425, 2/410, 411; 223/12
See application file for complete search history.

(56) References Cited

U.S. PATENT DOCUMENTS

| | | | | | |
|---|---|---|---|---|---|
| 859,736 | A * | 7/1907 | Brown | 2/175.6 |
| 1,373,713 | A * | 4/1921 | Schweizer-Caillaux | 2/175.6 |
| 1,453,862 | A * | 5/1923 | Check | 2/175.6 |
| 2,591,324 | A * | 4/1952 | Weikert | 2/175.6 |
| 3,166,766 | A * | 1/1965 | Banello, Jr. | 2/175.6 |
| 3,268,911 | A * | 8/1966 | Cox | 2/416 |
| 3,435,460 | A * | 4/1969 | Grant | 2/422 |
| 3,469,264 | A * | 9/1969 | Harris | 2/46 |
| 3,992,721 | A * | 11/1976 | Morton | 2/414 |
| 4,345,336 | A * | 8/1982 | Plastino | 2/414 |
| 4,491,256 | A * | 1/1985 | Payne et al. | 223/24 |
| 4,941,601 | A * | 7/1990 | Thomas et al. | 223/24 |
| 5,012,531 | A * | 5/1991 | Schoonover | 223/66 |
| 5,172,837 | A * | 12/1992 | Finney et al. | 223/23 |
| 5,226,180 | A * | 7/1993 | Leach | 2/411 |
| 5,289,591 | A * | 3/1994 | Andersen | 2/411 |
| 5,659,896 | A * | 8/1997 | Taylor | 2/12 |
| 5,725,134 | A * | 3/1998 | Weltge | 223/24 |
| 5,771,493 | A * | 6/1998 | Proctor | 2/209.13 |
| 5,865,333 | A * | 2/1999 | Wolfe | 220/4.21 |
| 5,887,289 | A * | 3/1999 | Theoret | 2/425 |
| 5,896,587 | A * | 4/1999 | Gentry | 2/425 |
| 6,094,749 | A * | 8/2000 | Proctor | 2/195.2 |
| 6,931,664 | B1 * | 8/2005 | Chen | 2/9 |
| 7,010,814 | B2 * | 3/2006 | Benziger | 2/209.13 |
| 7,043,761 | B2 * | 5/2006 | Epling | 2/7 |
| 7,096,512 | B2 * | 8/2006 | Blair | 2/410 |
| 7,406,721 | B2 * | 8/2008 | Husbands et al. | 2/172 |
| 7,975,317 | B2 * | 7/2011 | Rampell | 2/410 |
| 8,051,497 | B1 * | 11/2011 | Erhardt | 2/175.6 |
| 8,177,104 | B2 * | 5/2012 | Bryant | 223/13 |
| 8,191,742 | B1 * | 6/2012 | Brewer | 223/24 |
| 8,220,673 | B1 * | 7/2012 | Levin et al. | 223/84 |
| 2004/0034903 | A1 * | 2/2004 | Blair | 2/411 |
| 2005/0086727 | A1 * | 4/2005 | Shen | 2/411 |
| 2008/0083053 | A1 * | 4/2008 | Lin | 2/422 |
| 2012/0240310 | A1 * | 9/2012 | Franco et al. | 2/209.13 |
| 2012/0260405 | A1 * | 10/2012 | Shen | 2/411 |

* cited by examiner

*Primary Examiner* — Amber Anderson
(74) *Attorney, Agent, or Firm* — Arthur M. Peslak; Gertner Mandel & Peslak

(57) ABSTRACT

A safety hat for use by construction workers is disclosed. The safety hat is fabricated from a hard plastic type material or other equivalent impact resistant materials. The safety hat is in the general shape of existing baseball type caps. The safety hat has a hollow brim portion to receive the brim of the typical soft baseball cap and thereby secure the safety hat to the baseball cap so that the safety hat fits securely and comfortably on the user's head.

3 Claims, 6 Drawing Sheets

SAFETY HAT SYSTEM

PRIORITY CLAIM

This application is a Continuation-in-Part of co-pending U.S. patent application Ser. No. 13/155,537 filed Jun. 8, 2011.

BACKGROUND OF THE INVENTION

The present invention is directed to the field of safety headgear used to protect persons engaged in construction and related activities. In particular, the headgear is used to prevent head injuries due to impact from a fixed or moving hard object.

There are many available designs for safety helmets and other types of devices generally referred to as "hard hats". The existing safety helmets and hard hats suffer from various defects that make the helmets difficult for a user to wear comfortably. The first defect relates to the fact that existing safety helmet designs are difficult for a user to maintain on the head especially during activities when the user needs to bend down as gravity tends to pull the helmet off of the person's head. The only solution to this problem is to fit the existing helmet very tightly around the user's head which can create discomfort during long work shifts. In addition to the aforementioned problem, the existing designs are generally uncomfortable The primary object of the present invention is to cure these and other defects in the existing safety helmet designs. The present invention is designed for use in conjunction with a soft baseball type cap with a brim extending from the front thereof. As many of the typical users of safety helmets tend to also wear baseball type caps on a regular basis, it is contemplated that the present invention will be useful to a large number of potential users. As described and claimed below, the present invention is directed to a hard safety helmet that is adapted to receive the brim of a baseball cap so that the helmet can be comfortably and snugly received on the user's head.

SUMMARY OF THE INVENTION

A safety hat system to protect a worker's head from impact with hard objects comprising a semi-hemispherical hollow portion adapted to receive a user's head, a first brim extending from the semi-hemispherical portion wherein the brim comprises a hollow interior slot and a conventional baseball cap with a second brim wherein the second brim is adapted to be received in the hollow interior slot so that the baseball cap is joined to the semi-hemispherical portion of the first brim.

DETAILED DESCRIPTION OF THE INVENTION

The presently preferred embodiment of the present invention will now be described in terms of the appended drawings. As is well known to those of ordinary skill in the art, the appended claims shall not be construed as being limited by the preferred embodiment.

Figure 1:
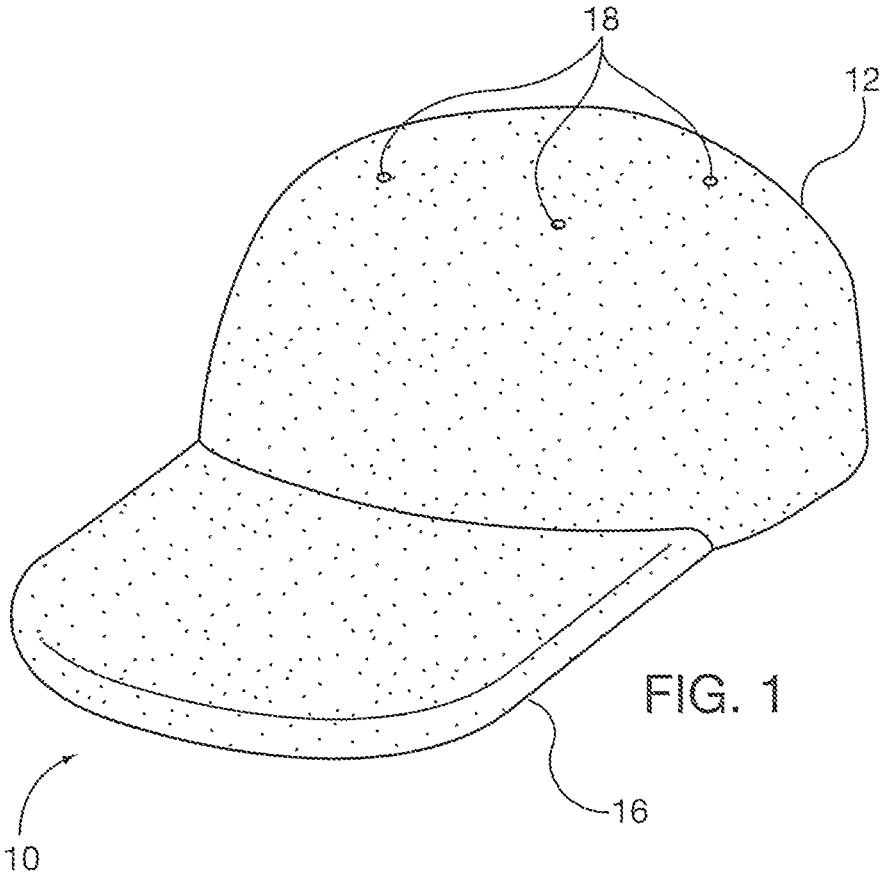
FIG. 1 is a front isometric view of an embodiment of the present invention.
Figure 2:
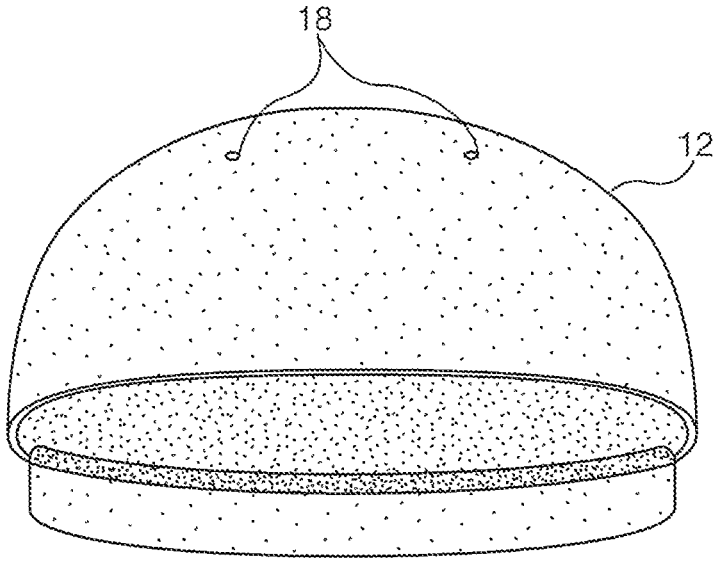
FIG. 2 is a rear elevation view of an embodiment of the present invention.
Figure 3:
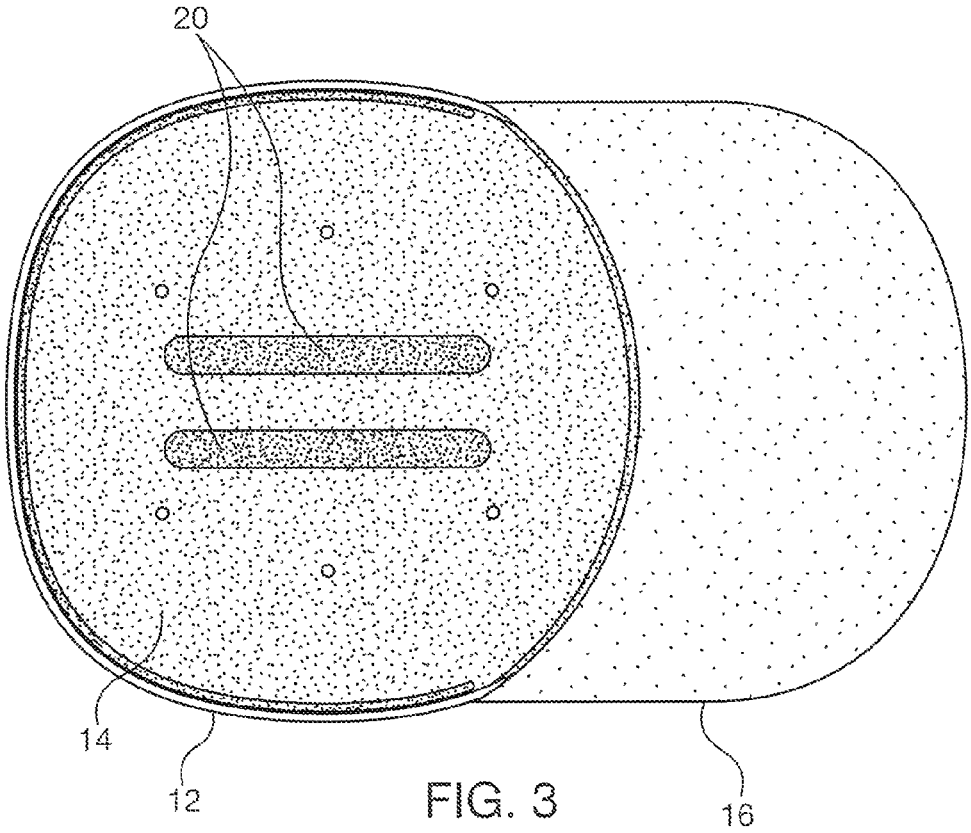
FIG. 3 is a bottom elevation view of an embodiment of the present invention.
Figure 4:
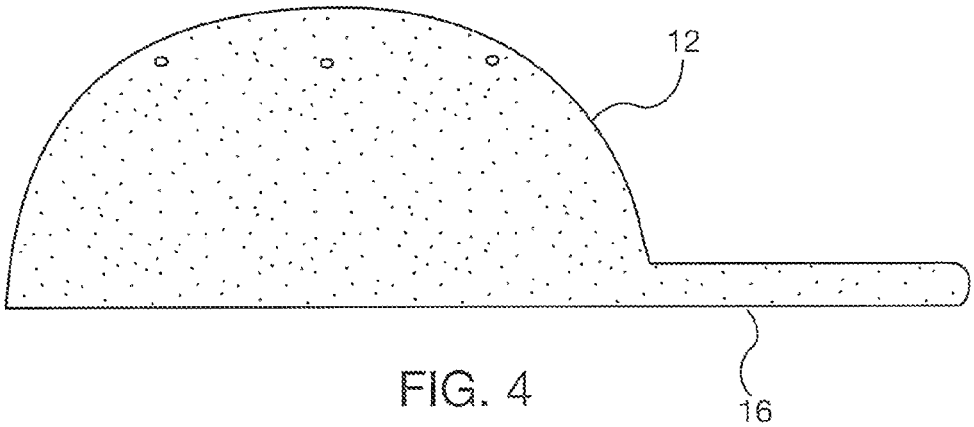
FIG. 4 is a side elevation view of an embodiment of the present invention.

As shown in FIG. 1, the present invention is directed to a hard safety hat 10. The safety hat 10 is contemplated to be fabricated from hard plastic or of equivalent protective materials that are resistant to impact. As can be seen in the Figures, the safety hat 10 is generally formed in the shape and proportions of a typical baseball type cap. The safety hat 10 has a semi-hemispherical portion 12 with a hollow interior 14 adapted to receive the user's head. A brim 16 extends from the front of the semi-hemispherical portion 12.

The semi-hemispherical portion 12 further comprises a plurality of vent holes 18. Disposed on the interior surface 13 of the semi-hemispherical portion 12 is a plurality of foam-like soft strips 20. The soft foam-like strips 20 are attached to the interior surface 13 by means of adhesive or other similar fastening means. The purpose of the foam strips 20 is to make the safety helmet 20 fit more comfortably and securely on the user's head.

Figure 5:
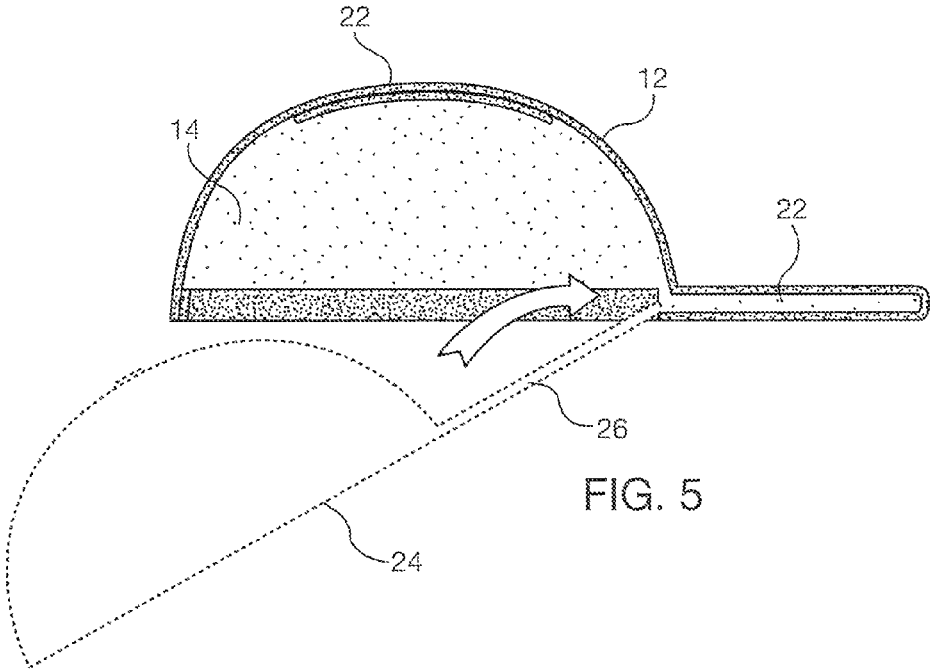
FIG. 5 is a cut-away side elevation view illustrating the interaction between an embodiment of the present invention and a baseball cap.

The brim 16 is shown in detail in FIG. 5. As can be seen in FIG. 5, the brim 16 comprises a hollow interior slot 22. The hollow interior slot 22 is adapted to receive the brim 26 of a typical user's soft baseball cap 24.

Figure 6:
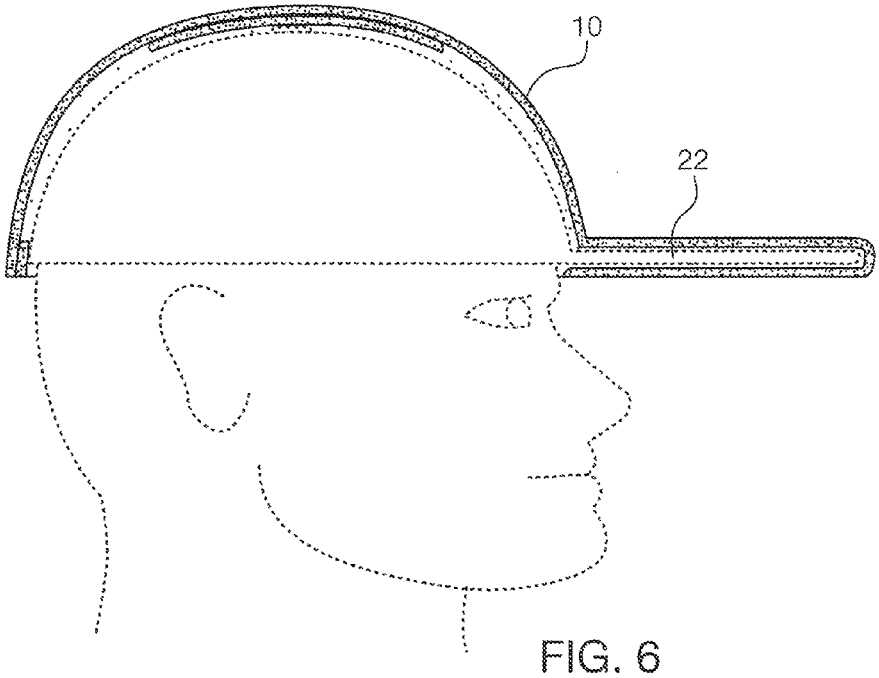
FIG. 6 is a side elevation view illustrating the use of an embodiment of the present invention.
Figure 7:
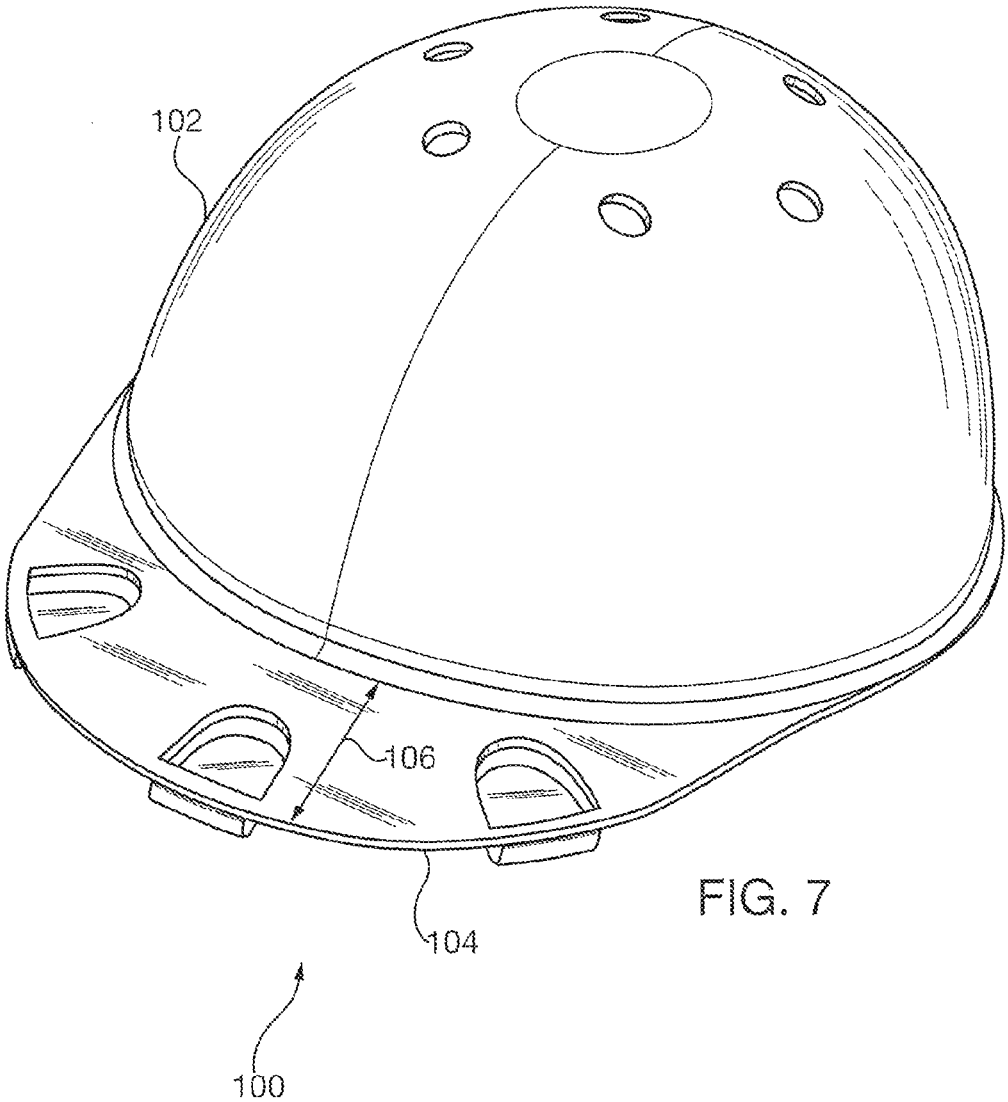
FIG. 7 is a front isometric view of an alternate embodiment of the present invention.
Figure 8:
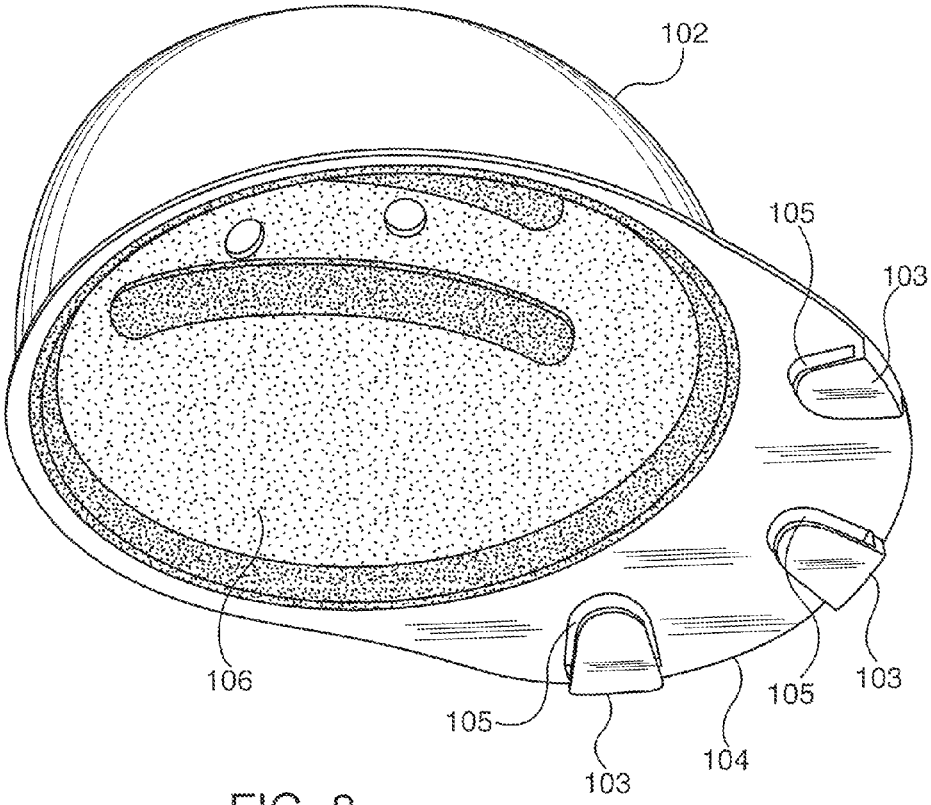
FIG. 8 is a bottom elevation view of the alternate embodiment of the present invention.

FIGS. 5 and 6 illustrate the use of the safety hat 10 of the present invention. The user will insert the brim 26 of a baseball type cap 24 into the hollow interior 22 of the brim 16. The user will thereby engage the baseball cap 24 with the safety hat 10. The engagement of the cap 24 and the safety hat 10 will allow the user to safely and comfortably wear the safety hat 10.

An alternate embodiment 100 of the present invention is illustrated in FIGS. 7 to 10. The alternate embodiment 100 is directed to a hard plastic safety helmet. The safety helmet 100 comprises a hemispherical portion 102 wherein the users head will be received. The hemispherical portion 102 further comprises foam inserts 106 for user comfort and fit. A brim 104 extends from the front of the hemispherical portion 102. The bottom side of the brim 104 comprises a plurality of relatively short tabs 103 in comparison to the length of the brim 106. The tabs 103 are formed such that a plurality of slots 105 are formed under the brim 104.

Figure 9:
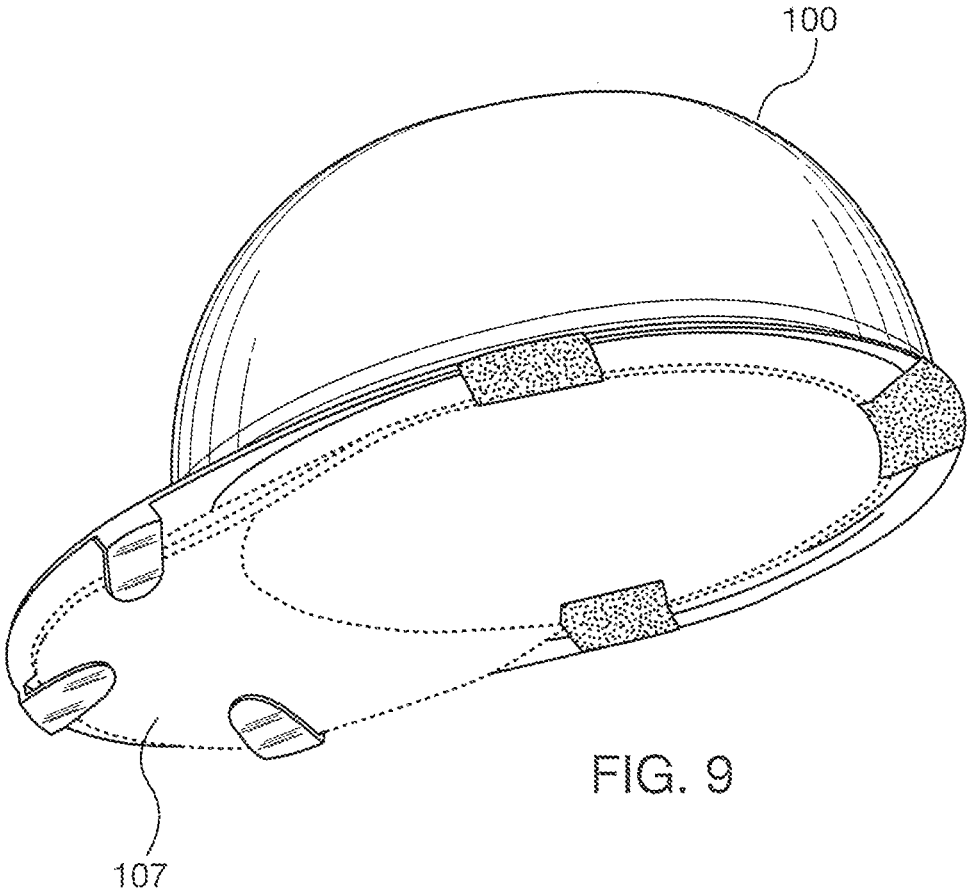
FIG. 9 is a bottom elevation view, illustrating the interconnection of the alternate embodiment with a baseball cap.
Figure 10:
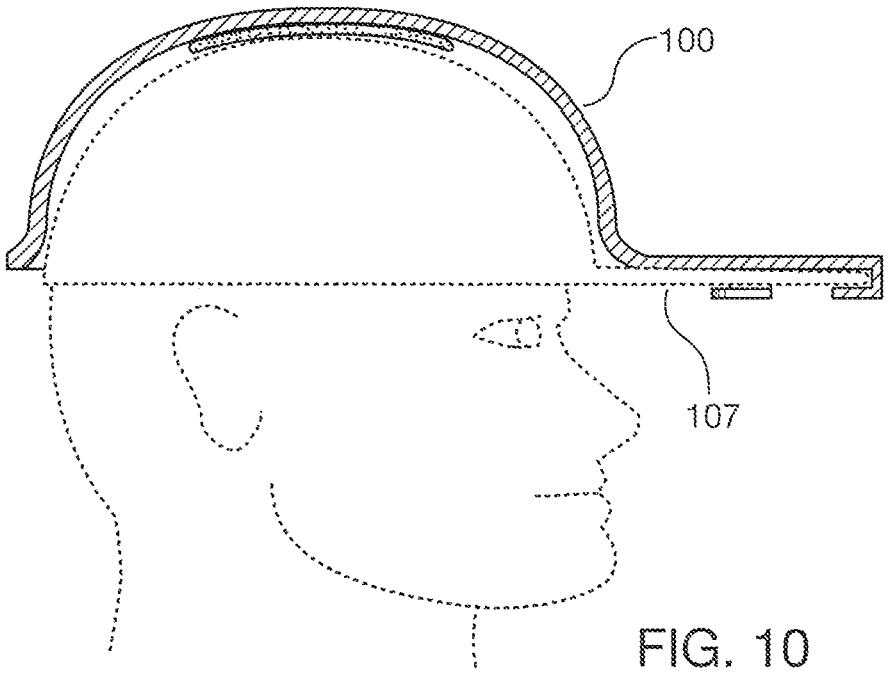
FIG. 10 is a cut-away side elevation view, illustrating the use of the alternate embodiment of the present invention.

As shown in FIG. 9, a baseball cap 107 fits inside the hemispherical portion 102 and is seemed in the slots 105 formed by the tabs 103. In this way, the user can comfortably use a baseball cap in connection with the safety helmet as shown in FIG. 12.

Those of ordinary skill in the art will recognize that the foregoing merely represents an embodiment of the present invention and that many obvious modifications may be made thereto without departing from the spirit or scope of the present invention as set forth in the appended claims.

What is claimed is:

1. A safety hat system to protect a user's head from impact with hard objects comprising:

a. a first hemispherical hollow portion fabricated from hard impact resistant material forming an interior portion adapted to receive the user's head;

b. a first brim fabricated from the hard impact resistant material of the hemispherical hollow portion and extending a first length from the hemispherical hollow portion to a front edge wherein the first brim has a plurality of substantially L-shaped tabs formed from the hard impact resistant material, the tabs have a second length extending downward from the front edge of the brim and toward the hemispherical hollow portion whereby the tabs form a plurality of slots and the second length is substantially shorter than the first length;

c. a conventional soft baseball cap with a second brim with a second front edge and a second hemispherical portion wherein the second brim is received in the plurality of slots and the second hemispherical portion is received in the first hemispherical hollow portion;

Wherein the safety hat system fits securely and comfortably on the user's head.

2. The safety hat system of claim 1 wherein the first hemispherical hollow portion has an interior portion that has a plurality of soft foam strips thereon.

3. The safety hat system of claim 1 wherein the first hemispherical hollow portion comprises a plurality of vent holes.

* * * * *